United States Patent [19]

Collins, Jr.

[11] Patent Number: 4,877,082

[45] Date of Patent: Oct. 31, 1989

[54] CONVERGENT STRAND ARRAY LIQUID PUMPING SYSTEM

[75] Inventor: Earl R. Collins, Jr., La Canada, Calif.

[73] Assignee: United States of America as represented by the Administrator, National Aeronautics and Space Administration, Washington, D.C.

[21] Appl. No.: 337,767

[22] Filed: Apr. 13, 1989

[51] Int. Cl.[4] ..... F28D 15/02

[52] U.S. Cl. ..... 165/104.26; 165/41; 122/366; 222/187; 239/145; 417/53; 417/572

[58] Field of Search ..... 165/104.26, 41; 122/366; 222/187; 239/145; 417/53, 572

[56] References Cited

U.S. PATENT DOCUMENTS

| | | | |
|---|---|---|---|
| 2,551,114 | 5/1951 | Goddard . | |
| 2,885,123 | 5/1959 | Turpin | 222/187 |
| 3,174,688 | 3/1965 | Chatten | 239/20 |
| 3,379,855 | 4/1968 | Forrester et al. | 219/274 |
| 3,428,222 | 2/1969 | Wright . | |
| 3,576,210 | 4/1971 | Trent | 165/104.26 |
| 3,984,051 | 10/1976 | Labbe et al. | 239/44 |
| 4,109,709 | 8/1978 | Honda et al. | 165/104.26 |
| 4,116,266 | 9/1978 | Sawata et al. | 165/104.26 |

*Primary Examiner*—Albert W. Davis, Jr.
*Attorney, Agent, or Firm*—Thomas H. Jones; John R. Manning; Charles E. B. Glenn

[57] ABSTRACT

A surface-tension liquid pumping system is provided by one or more arrays of converging solid monofilament fibers or metal wires (strands) spaced apart at an input end to gather liquid, and gathered close together at the opposite end where menisci forms between wetted strands to force liquid in the direction of convergence of the strands. The liquid pumping system is independent of gravity. It is illustrated as being used in a heat pump having a heating box to vaporize liquid and a condensing chamber. Condensed liquid is returned by the pumping system to the heating box where it is again vaporized. A vapor tube carries the vapor to the condensing chamber. In that way, a closed system pumps heat from the heating box to the evaporating chamber and from there radiated to the atmosphere.

6 Claims, 4 Drawing Sheets

CONVERGENT STRAND ARRAY LIQUID PUMPING SYSTEM

ORIGIN OF THE INVENTION

The invention described herein was made in the performance of work under a NASA contract, and is subject to the provisions of Public Law 96-517 (35 USC 202) in which the Contractor has elected not to retain title.

TECHNICAL FIELD

This invention relates to passive liquid feed systems that operate independently of gravity, and more particularly to an array of convergent filaments in a surface tension, liquid pumping system.

BACKGROUND ART

Nonmechanical pumping of liquid is desirable and sometimes required for some applications where power for driving a pump is not available or is very precious, such as in a remote terrestrial location or a space laboratory. The problem is most common in space because of the lack of gravity that might otherwise be used in moving a liquid from one point to another, but the problem can also occur in terrestrial applications at remote locations.

An example of a terrestrial application is in connection with transporting oil from the arctic through a pipeline laid over tundra. The oil is first heated in a storage tank and then pumped through an elevated pipeline. Because the ground is always frozen below the surface, the pipeline is not buried and is instead elevated to a height sufficient to allow animals to pass beneath it and insulated to minimize heat loss from the oil in order to maintain its lowered viscosity. Stanchions which support the pipeline will, however, conduct heat into the tundra sufficient to cause significant thawing around the tundra. During some period of the year, the thaw may extend from one stanchion to the next, thus creating a continuous ribbon of thawed tundra that may deter animals from crossing. To prevent creation of this ribbon of thawed tundra, it is desirable to provide a heat pipe that conducts heat away from the base of each stanchion and into the air.

A heat pump operating without any mechanical motion of parts may consist of a heat exchange system in which liquid is evaporated in a space in thermal contact with the base of the stanchion. The vapor produced is then carried by a tube to a condensing space where heat is radiated into the atmosphere. Condensed liquid that accumulates in that condensing space must then be pumped back into the space in thermal contact with the base of the stanchion. The problem then is to pump the return liquid without the use of a mechanical pump and independently of gravity.

Nonmechanical pumping of liquids has been achieved in the prior art by porous materials used in wicking systems, such as that disclosed in U.S. Pat. No. 3,984,051 and by hollow capillary tubes, such as that using tapered capillary tubes disclosed in U.S. Pat. No. 3,379,855. However, these known prior-art systems have limitations, so there is a need for nonmechanical pumping systems that do not rely upon internal absorption or capillary tubes.

STATEMENT OF THE INVENTION

In accordance with the present invention, a surface-tension liquid pumping system is comprised of an array of converging solid monofilament fibers or metal wires (hereinafter referred to as strands) spaced apart at an input end and gathered close together at the opposite end where a meniscus is formed between the converging strands. Surface tension will force liquid from the input end to the opposite end without any mechanical pumping elements. Support elements of suitable geometric shape (linear, rectangular, elliptical, circular, or the like) are provided to space the strands at the input end and to gather them at the output end. A housing encloses the array of strands and secures the spacing and gathering support elements. Alternatively, the support elements may be made as an integral unitary part of the housing.

The novel features that are considered characteristic of this invention are set forth with particularity in the appended claims. The invention will best be understood from the following description when read in connection with the accompanying drawings.

DETAILED DESCRIPTION OF THE INVENTION

Figure 1A:
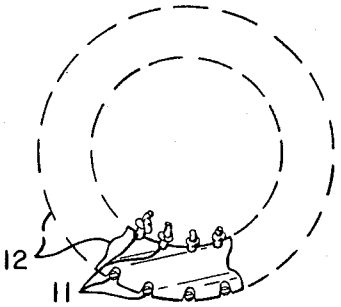
FIG. 1*a* illustrates a plan view of a spacing element at the liquid input end of strands as seen from the left in FIG. 1.
Figure 1C:
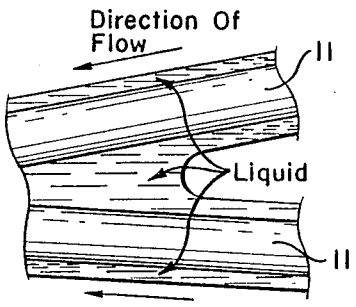
FIG. 1*c* illustrates sections of two converging strands wetted by liquid.
Figure 1B:
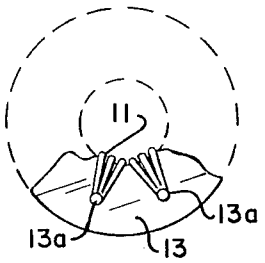
FIG. 1*b* illustrates a plan view of a gathering element at the liquid output end of strands as seen from the left in FIG. 1.
Figure 1:
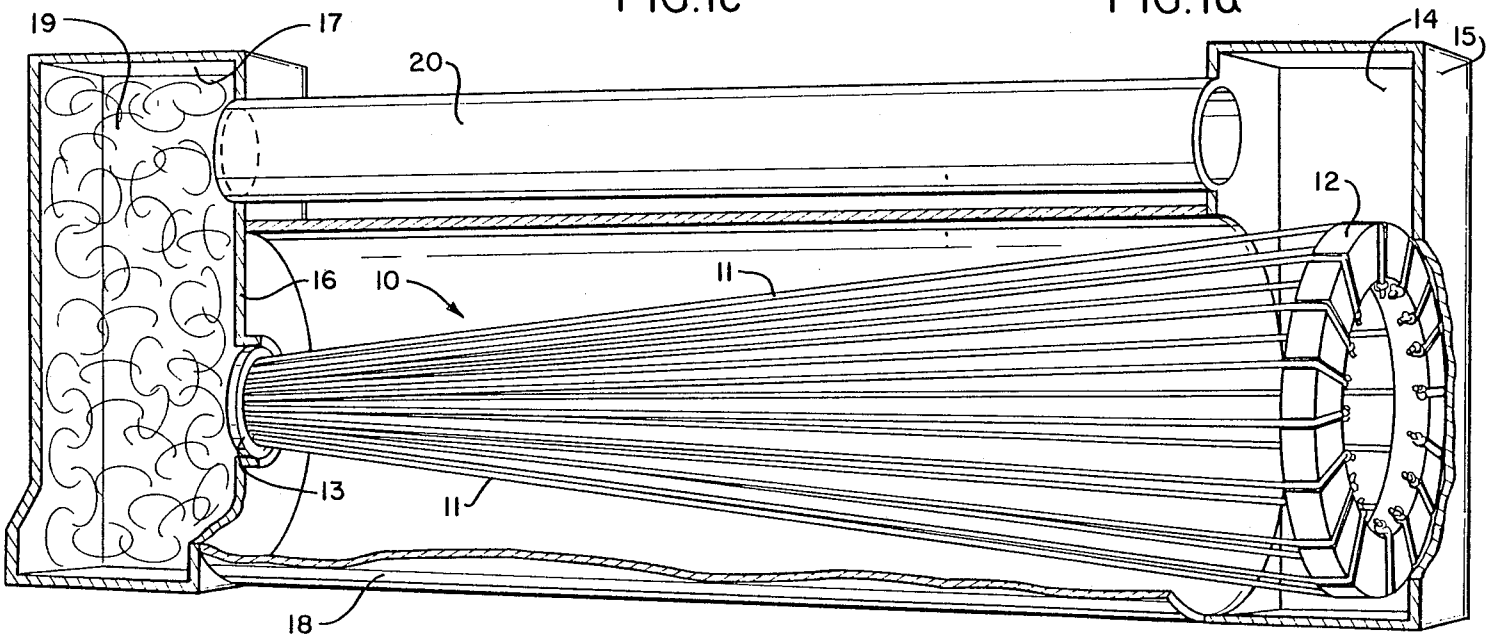
FIG. 1 illustrates a surface-tension liquid pumping system, which operates without the use of moving parts and independently of gravity, in accordance with the present invention used in a heat pump shown in an isometric view partially broken away.

Referring to FIG. 1, a conical array 10 of strands 11 made of monofilament fibers (such as polymeric monofilament material commercially available for use as fishing line) or of small gauge metal wire (such as copper wire commercially available for use in small transformers) is supported between annular elements 12 and 13 of different diameters. A plan view of the spacing element 12 (shown in FIG. 1*a* as seen from the left in FIG. 1) is of a diameter sufficiently large to space apart the strands at the input end where liquid accumulates in a condensing chamber 14. That annular spacing element is affixed to the inside face of a condensing plate 15 of the chamber 14. A plan view of the annular gathering element 13 is shown to a larger scale in FIG. 1*b* as seen from the left.

A knot is tied in each strand before it is placed in a groove across the face and side of the spacing element 12, and before the spacing element 12 is affixed flat against the condensing plate 15, such as by epoxy or small screws. Once the annular element 12 is affixed flat against the inside face of the condensing plate 15, each strand is secure in its slot due to the knot tied in its end. This firmly secures on end of each strand in a radial slot cut in the element 12. The free ends of the strands are then drawn taut through the opening of the annular gathering element 13 and secured to posts 13*a* by a half hitch or other suitable knot with three strands per post. To assure that the knot remains secure, epoxy may be applied to the strands on the posts. This gathers the strands so that, in passing through the opening of the annular element 13, each strand comes in contact with adjacent strands.

The gathering element 13 is affixed to a wall 16 of a heating box 17. Alternatively, the gathering element 13 may be simply an opening in the wall 16 with posts spaced around the opening. A housing 18 protects the strands 10 and spaces the condensing chamber 14 away from the heating box 17.

Once the strands 11 have been wetted from the input end to the output end, surface tension of the liquid in a meniscus between two adjacent strands near the output end will force liquid toward the output end (from right to left) in FIG. 1, as shown in FIG. 1*c* by arrows indicating the direction of flow. As surface tension forces liquid to the left, it draws liquid from the strands passing through slots on the side of the spacing element 12 on the right. As liquid is drawn out of the accumulation area in the annular support element 13 for evaporation, surface tension forces liquid to replace the liquid drawn out.

It should be noted that in passing through the gathering element 13, the adjacent strands are all parallel. In the short parallel section of the strands, the liquid is no longer driven by surface tension. It is instead driven by more liquid behind it that is forced into that parallel section by surface tension between converging strands. Thus, the liquid will tend to be moved away from the converging strands and into the heating box 17. This parallel section may be made longer to provide a larger place for liquid to accumulate, but in a heat pump absorbing material 19 (such as cotton) is provided in the heating box to immediately distribute accumulated liquid in the heating box for vaporization.

As just noted above, for use in a heat pump as illustrated in FIG. 1, the spacing support element 12 is spaced away from the gathering element 13 by the cylindrical housing 18 which protects the array 10 of strands. Thus, at the input end, the element 12 spaces the strands apart in the condensing chamber 14 over a distance sufficient to allow condensing vapor to gather on the plate 15, the spacing element 12 affixed to the plate 15, and the strands to keep the strands wetted. Surface tension of liquid in a meniscus between adjacent strands at the exit end (as shown in FIG. 1*c*) contiually forces the liquid wetting the strands to move in the direction of the gathering element 13. Surface tension is thus the force which drives the liquid from the condensing chamber into the heating box 17, while a vapor tube 20 provides for flow of liquid vapor from the heating box 17 to the condensing chamber 14.

Figure 2B:
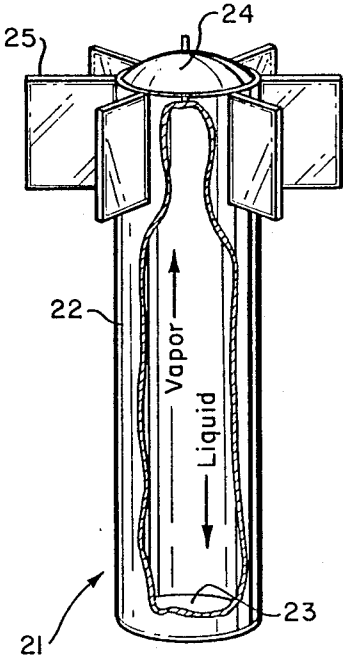
FIG. 2b (Prior Art)
FIG. 2*a* illustrates schematically a cross section of the heat pump in FIG. 1 for comparison with a prior-art heat pump shown in FIG. 2*b* which has no moving parts but relies upon gravity.
Figure 2A:
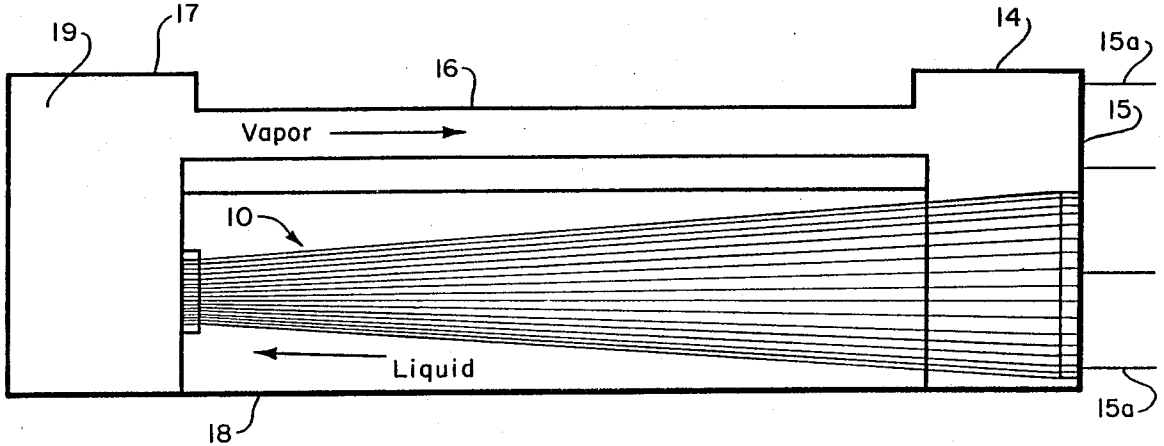

Referring now to FIG. 2*b*, a prior-art heat pump 21 is illustrated for comparison with the heat pump of FIG. 1, shown schematically in FIG. 2*a*. For convenience, elements of the pumping apparatus shown in FIG. 1 and illustrated schematically in FIG. 2*a* are identified by the same reference numerals, namely a conical array 10 of strands, a heating box 17, a condensing chamber 14, a condensing plate 15, a housing 18, and a vapor tube 16. In the prior-art heat pump 21, a closed hollow cylinder 22 has a flat base plate 23 at the bottom end which is buried in the tundra or is otherwise placed in thermal contact with something out of which heat is to be pumped. Liquid in the chamber is then vaporized in the cylinder 22, and the vapor rises. At the top of the cylinder, the vapor condenses and a dome 24 accumulates liquid. The liquid formed on the dome runs to the wall of the cylinder, and from there down to the base plate 23, all under the force of gravity. Returned liquid is heated at the base plate and vapor rises in the cylinder to complete one cycle. Fins 25 at the top of the cylinder enhance the radiation of heat for the condensation of the vapor.

The heat pump of FIG. 2*a* is also a closed cycle system, and to enhance the radiation of heat from the condensing chamber 14, its end plate 15 may be provided with fins 15*a*. Liquid that accumulates in the heating box 17 is dispersed by the porous material 19 so that it may be more readily vaporized. The vapor flows through the tube 16 into the condensing chamber 14. Condensed vapor on the plate 15 gathers on strands at the input end of the conical array 10. The return flow of liquid, driven by surface tension in the conical array 10, continually replenishes liquid that is vaporized, while the tube 16 continually replenishes vapor in the condensing chamber. As the vapor condenses in the chamber 14, the vapor pressure drops below that of the vapor coming out of the heating box. This pressure differential keeps vapor moving into the condensing chamber. The closed cycle thus functions to pump heat from the heating box 17 to the condensing chamber 14. From there heat radiates into the atmosphere.

Because of this horizontal flow of liquid and vapor, all without reliance on gravity, the heating box 13 of the heat pump shown in FIG. 2*a* can be thermally connected directly to the base of a stanchion (not shown) that supports an oil pipeline above arctic tundra. The heat pump will draw heat directly out of the base of the stanchion and radiate it into the atmosphere before it reaches the tundra so that the tundra that supports the stanchion will not thaw. Thus, the heat pump of FIG. 2*a* has the advantage that the heating box may be thermally connected directly to the stanchion because it is horizontally oriented. A further advantage is that the closed cycle will operate more efficiently with a greater volume of recirculated liquid by the surface tension of the strands because the number of strands may be readily increased, as will now be described.

Figure 4:
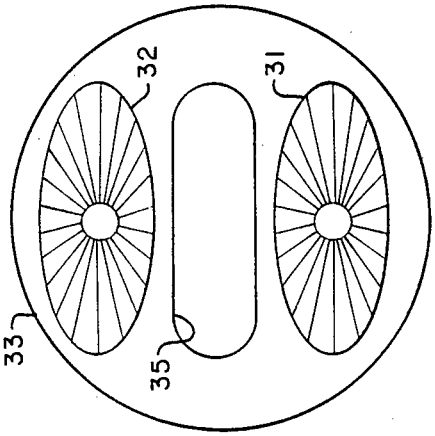
FIG. 4 illustrates schematically a cross section taken on line 4—4 in FIG. 3 to show an elliptical shape of the array geometry at the input end and an annular shape of the array geometry at the output end of the surface-tension pumping apparatus, and the shape of the vapor tube between a heating box and a condensing chamber.
Figure 3:
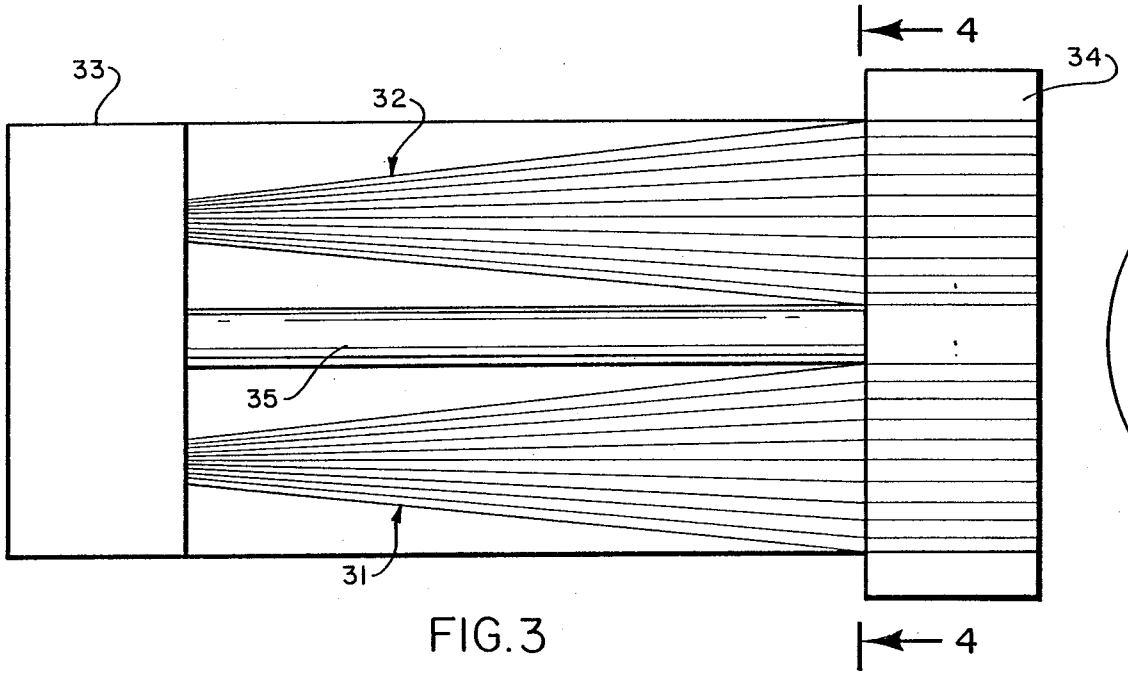
FIG. 3 illustrates schematically a plan view of a second embodiment of a heat pump utilizing two surface-tension liquid pumping systems and one vapor tube arranged between a heating box and a condensing chamber.
Figure 5:
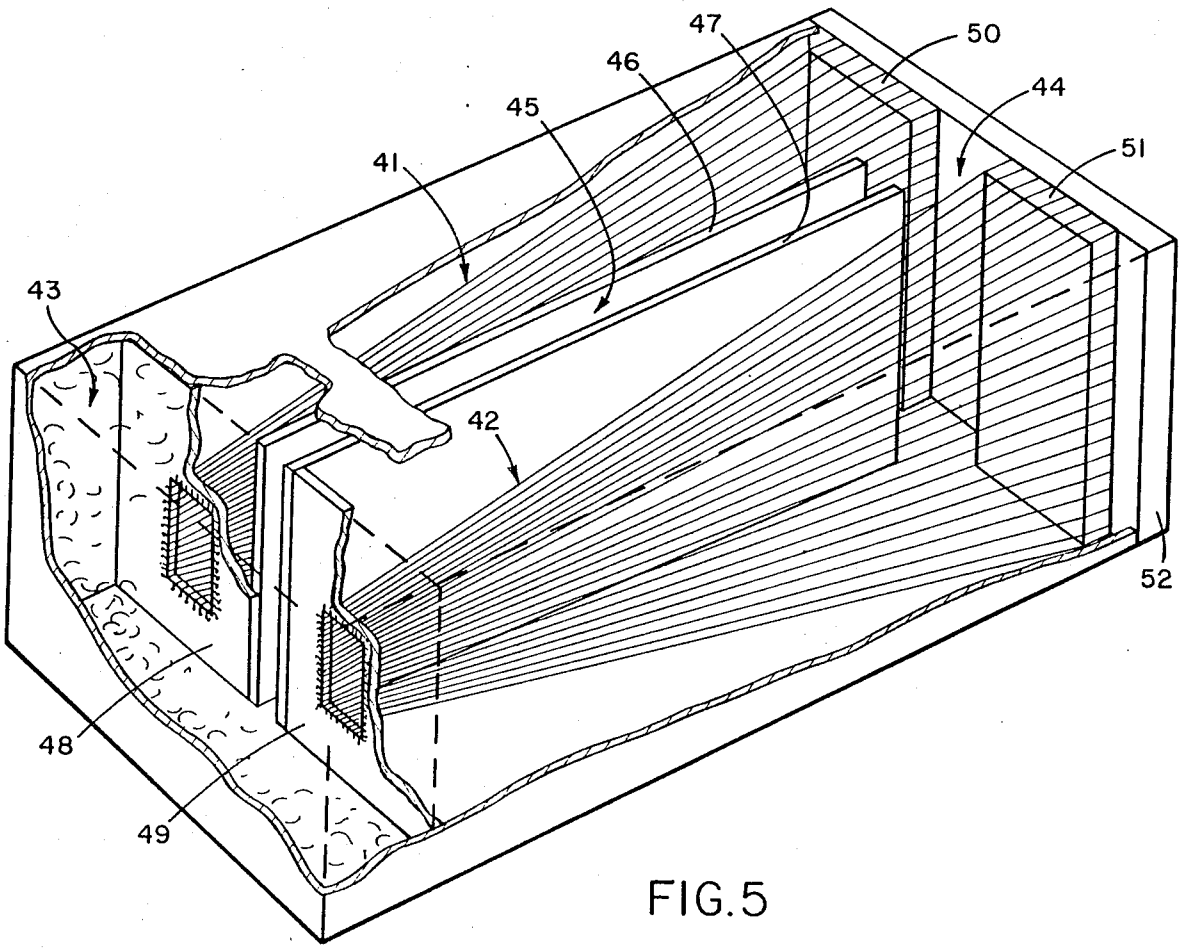
FIG. 5 illustrates a plurality of rectangular arrays of strands for use in a surface-tension liquid pumping system with a rectangular vapor tube between a heating box and a condensing chamber.

FIG. 3 illustrates schematically two arrays 31 and 32 of strands between a heating box 33 and a condensing chamber 34 and a large vapor tube 35. FIG. 4 illustrates schematically a cross section taken on line 4—4 of FIG. 3. FIG. 5 illustrates schematically in a perspective view partially broken away two arrays 41 and 42 of strands between a heating box 43 and a condensing chamber 44 and a large vapor tube 45 formed by adjacent side walls 46 and 47 which, together with an overall housing not only defines the heating box 43 and the vapor tube 45 but also the condensing chamber 44. Note that the gathering elements for the arrays 41 and 42 are here formed by openings of plates 48 and 49; posts are provided to secure the ends of the strands to those plates. Spacing element 50 and 51 affixed to a condensing plate 52 are rectangular and may each be provided with a grid of horizontal and vertical slots on the back side. The strands in these back-side slots are continuous from the gathering element in the plates 48 and 49 across the backs of the spacing elements 50 and 51 and from there back to the gathering elements.

Although particular embodiments of the invention have been described and illustrated herein, it is recognized that modifications and variations may readily occur to those skilled in the art. Other applications of the heat pump, and indeed of the surface-tension pumping apparatus itself, will occur to those skilled in the art, particularly applications aboard a spacecraft. Consequently, it is intended that the claims be interpreted to cover such modifications and variations.

I claim:

1. A surface-tension liquid pumping system comprised of at least one array of taut converging strands spaced apart at one end adapted to receive liquid and gathered close together at the opposite ends of the strands to allow liquid wetting the strands to form menisci between adjacent strands where they approach convergence thereby to cause surface tension to force liquid wetting the strands to flow toward the converging ends of the strands.

2. A passive liquid pumping system as defined in claim 1 wherein said spacing element spaces said strands uniformly with each strand spaced equally from adjacent strands, and said gathering element holds said strands with each strand converging with adjacent strands, and a housing surrounding said array of strands supporting said spacing element spaced apart from said gathering element to protect said array of strands and maintain said strands taut.

3. A passing liquid pumping system as defined in claim 2 wherein said spacing element spaces said strands in a closed geometric pattern, and said gathering elements gathers said strands in a closed geometric pattern.

4. A passive liquid pumping system as defined in claim 3 wherein said housing includes a chamber for receiving liquid which wets said strands at said spacing element, and means for utilizing liquid gathered at said gathering element.

5. A passive liquid pumping system as defined in claim 3 wherein said utilizing means is a heating box for vaporizing said liquid and said chamber is a condensing chamber, and including a tube for guiding vapor flow from said heating box to said vaporizing chamber, thereby to provide a system for pumping heat from said box to said chamber from which heat is radiated out to the atmosphere.

6. A passive liquid pumping system for forcing liquid from one place to another independent of gravity comprised of an array of converging strands held taut between a spacing element at one end of said strands and a gathering element at the opposite end of said strands, where said spacing element is positioned at said one place and said gathering element is positioned at said other place, thereby to cause liquid wetting said strands to form menisci between adjacent strands where they approach convergence, and thus cause surface tension to force liquid wetting the strands to flow toward the converging ends of said strands independent of gravity and without any moving parts.

* * * * *